US007901518B2

(12) United States Patent
Berner et al.

(10) Patent No.: US 7,901,518 B2
(45) Date of Patent: Mar. 8, 2011

(54) COMMERCIAL DISHWASHER WITH AIR DEFLECTOR ARRANGEMENT

(75) Inventors: Dietrich Berner, Waldstetten (DE); Heinrich Gonska, Offenburg (DE); Peter Stolla, Oberkirch (DE)

(73) Assignee: Premark FEG L.L.C., Wilmington, DE (US)

( * ) Notice: Subject to any disclaimer, the term of this patent is extended or adjusted under 35 U.S.C. 154(b) by 510 days.

(21) Appl. No.: 11/914,556

(22) PCT Filed: May 19, 2006

(86) PCT No.: PCT/US2006/019493

§ 371 (c)(1),
(2), (4) Date: Feb. 11, 2008

(87) PCT Pub. No.: WO2006/127478

PCT Pub. Date: Nov. 30, 2006

(65) Prior Publication Data

US 2008/0264458 A1 Oct. 30, 2008

(30) Foreign Application Priority Data

May 20, 2005 (DE) ..... 10 2005 023 428

(51) Int. Cl.
*B08B 3/00* (2006.01)

(52) U.S. Cl. ..... 134/56 D; 134/57 D; 134/58 D

(58) Field of Classification Search ..... 134/56 D, 134/57 D, 58 D

See application file for complete search history.

(56) References Cited

U.S. PATENT DOCUMENTS

| | | | | |
|---|---|---|---|---|
| 3,068,877 | A | 12/1962 | Jacobs | |
| 3,397,708 | A * | 8/1968 | Braden | 134/57 R |
| 3,398,756 | A | 8/1968 | Kauffman | |
| 3,807,420 | A * | 4/1974 | Donselman et al. | 134/114 |
| 3,952,640 | A * | 4/1976 | Kuechler | 126/299 D |
| 4,179,821 | A * | 12/1979 | Herbst et al. | 34/235 |

(Continued)

FOREIGN PATENT DOCUMENTS

DE 10023346 11/2001

(Continued)

OTHER PUBLICATIONS

EPO Supplementary Search Report, corresponding EP Application EP 06760195.5, Sep. 2, 2008, 3 pages.

(Continued)

*Primary Examiner* — Michael Barr
*Assistant Examiner* — Charles W Kling
(74) *Attorney, Agent, or Firm* — Thompson Hine LLP

(57) ABSTRACT

A commercial dishwasher (2) has a spray chamber (4) for holding items (6) to be washed and is designed for loading and unloading batches of items (6) to be washed into and from a region (12) for items to be washed. The dishwasher (2) has a fan (18) for producing an air stream (20) which passes from an air inlet (14) below the region (12) for items to be washed, through the spray chamber (4), to an air outlet (16), with the air stream (20) in the spray chamber (4) being passed through the region (12) for items to be washed in order to dry the items (6) which have been washed. A deflector arrangement (22) acts on the air stream (20) entering the spray chamber (4) through the air inlet (14) in order for the air stream (20) to enter the region (12) for items to be washed in a uniformly distributed manner from below.

17 Claims, 5 Drawing Sheets

U.S. PATENT DOCUMENTS

| | | | | |
|---|---|---|---|---|
| 4,188,732 | A * | 2/1980 | Quayle | 34/570 |
| 5,881,746 | A * | 3/1999 | Buser et al. | 134/58 D |
| 6,170,166 | B1 * | 1/2001 | Johansen et al. | 34/62 |
| 2003/0140517 | A1 * | 7/2003 | Schmid | 34/78 |
| 2004/0261820 | A1 * | 12/2004 | Monsrud et al. | 134/10 |

FOREIGN PATENT DOCUMENTS

| | | | |
|---|---|---|---|
| DE | 10058188 | | 5/2002 |
| DE | 10058188 | A1 * | 5/2002 |
| EP | 0711528 | | 5/1996 |
| EP | 0978250 | | 2/2000 |
| EP | 1 230 891 | | 1/2002 |
| GB | 2263969 | | 8/1993 |

OTHER PUBLICATIONS

International Search Report issued regarding International Application No. PCT/US2006/019493 (Oct. 12, 2006).

Written Opinion issued regarding International Application No. PCT/US2006/019493 (Oct. 12, 2006).

* cited by examiner

COMMERCIAL DISHWASHER WITH AIR DEFLECTOR ARRANGEMENT

The present application is based on, and claims priority from, German Application Number 10 2005 023 428.3, filed May 20, 2005, the disclosure of which is hereby incorporated by reference herein in its entirety.

The invention relates to a commercial dishwasher which has a spray chamber for holding items to be washed, and which is designed for loading and unloading batches of items to be washed, according to the patent claims.

Commercial dishwashers, which are designed for loading and unloading a spray chamber with batches of items to be washed, are in particular front-loader dishwashers or hood-type dishwashers. In front-loader dishwashers, the items to be washed are placed in a rack and the rack which is loaded with items to be washed is placed in the spray chamber through a front door and, after cleaning, is removed again through the front door. In hood-type dishwashers, the dish racks which are loaded with items to be washed are pushed manually into the spray chamber from an entry side and manually removed from the spray chamber from an exit side when a washing programme is complete. Front-loader dishwashers and hood-type dishwashers contain only a single spray chamber for treating the items to be washed. The front-loader dishwashers may be under-counter dishwashers (under-counter warewashers) or top-counter dishwashers (top-counter warewashers). Items to be washed are usually cleaned by at least one cleaning process, during which the items to be washed are sprayed with a cleaning liquid, and at least one subsequent final-rinse process, during which the items to be washed are sprayed with final-rinse liquid. The final-rinse liquid may be fresh water or a mixture of fresh water and rinsing agent. Commercial dishwashers which are designed to be charged with batches are also called batch dishwashers (batch warewashers).

Items to be washed may be, in particular, dishes, glasses, cutlery, bowls, pots and pans, trays, boxes etc.

In contrast to domestic dishwashers, in which a washing programme which involves at least one cleaning process and at least one subsequent final-rinse process lasts for between 30 mins and 2.5 hours, the cycle time for a washing programme including at least one cleaning process and at least one subsequent final-rinse process in a commercial dishwasher is between one minute and six minutes.

A drying process in a domestic dishwasher lasts between 10 minutes and 30 minutes and usually takes place inside the said domestic dishwasher.

In commercial dishwashers, it is customary to remove the items, which have been washed and are still hot, from the machine after the final-rinse process, and to leave them to dry in the ambient air for 4 to 10 minutes. In order to dry the items which have been washed, they are usually left in the racks in which they were arranged to be cleaned in the dishwasher.

U.S. Pat. No. 3,807,420 describes a domestic dishwasher having an air outlet in an upper region of the spray chamber and an air inlet in a lower door region, with a fan for sucking air through the air outlet being arranged below the spray chamber.

EP 0 978 250 A2 discloses arranging an electric fan at an outlet of a duct in a domestic dishwasher in order to pass an air/steam mixture out of a spray chamber in the dishwasher over a heat-exchange surface in the duct. The heat-exchange surface here is at a temperature which is below the dew point of the air/steam mixture, with the outlet of the duct again issuing into the washing tank.

U.S. Pat. No. 4,179,821 and U.S. Pat. No. 3,398,756 disclose dishwashers which, by heating up air at the bottom of a washing chamber, produce a convection flow of moisture-laden air through an outlet arranged in an upper region of the washing chamber, and out of the dishwasher. The air flowing out of the dishwasher is in this case replaced by ambient air which enters through a gap between a front door and a lower housing part of the dishwasher.

EP 0 711 528 A1 describes a dishwasher having a fan which is arranged below the spray chamber and extracts air through an air outlet in the top of the spray chamber. Ambient air enters the spray chamber through an inlet in a side wall of the spray chamber and flows through the items which have been washed from the side.

On account of the short cycle times of washing programmes in a commercial dishwasher, known drying methods for domestic dishwashers cannot be used in a commercial dishwasher. The aim of the invention is to achieve the object of drying the items which have been washed in a commercial dishwasher in a short time with a satisfactory drying result.

According to the invention, this object is achieved by the attached patent claims. Further features of the invention can be found in the subclaims.

The invention is described below with reference to the drawings using preferred embodiments as examples. In the drawings.

Figure 1:
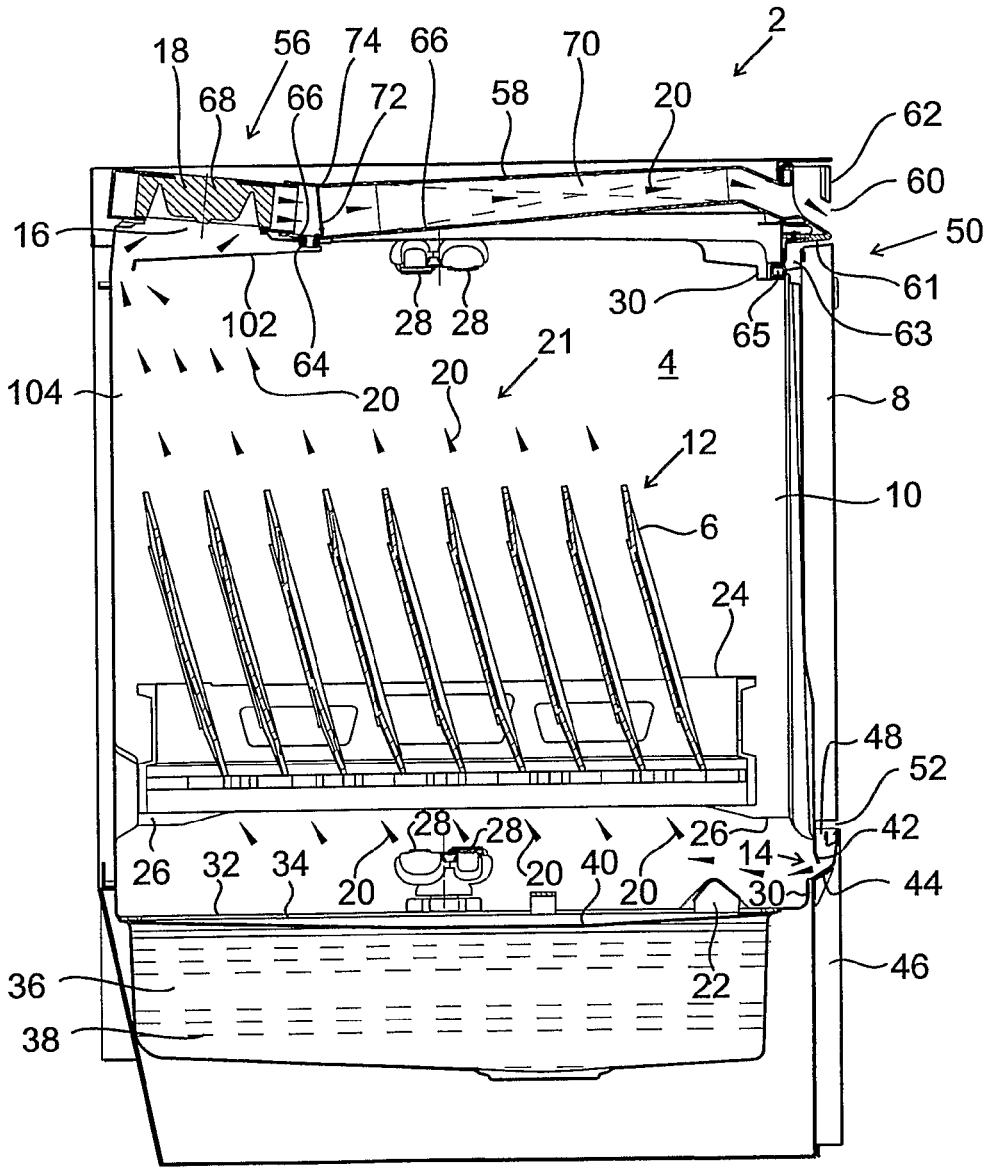
FIG. 1 shows a sectional side view of a commercial dishwasher according to the invention.
Figure 2:
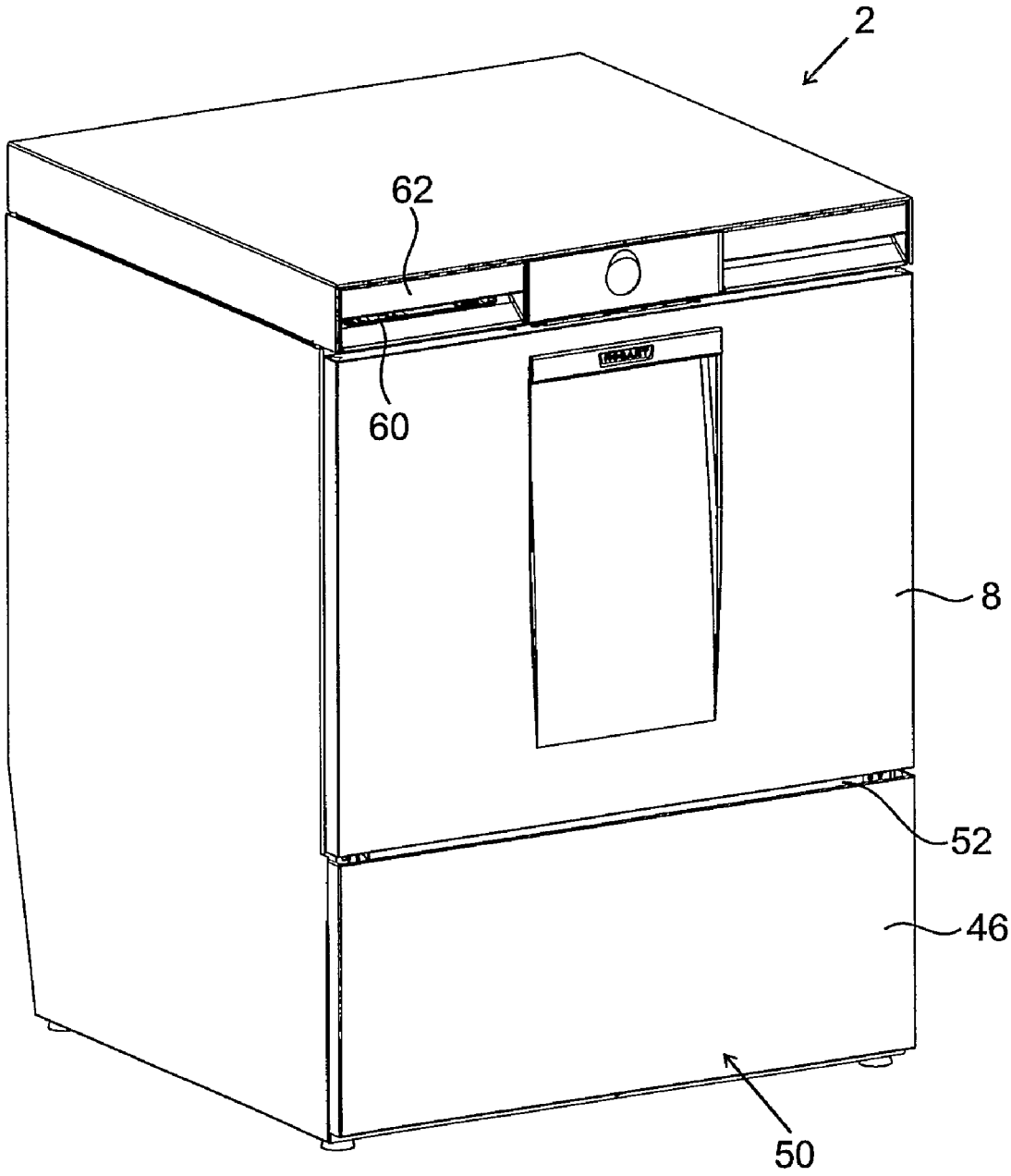
FIG. 2 shows a perspective view of the commercial dishwasher from FIG. 1.
Figure 3:
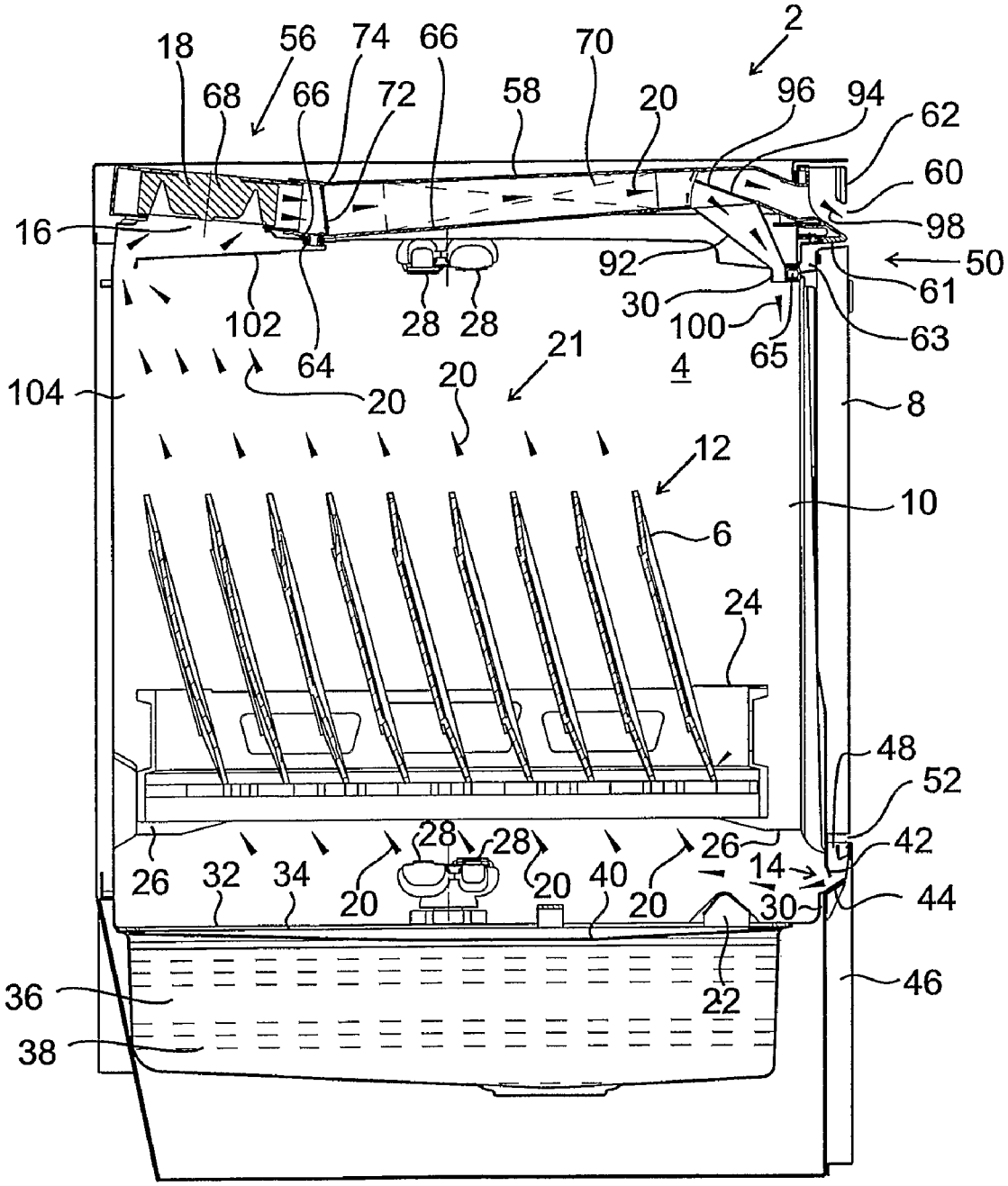
FIG. 3 shows a sectional side view of a further embodiment of a commercial dishwasher according to the invention.
Figure 4:
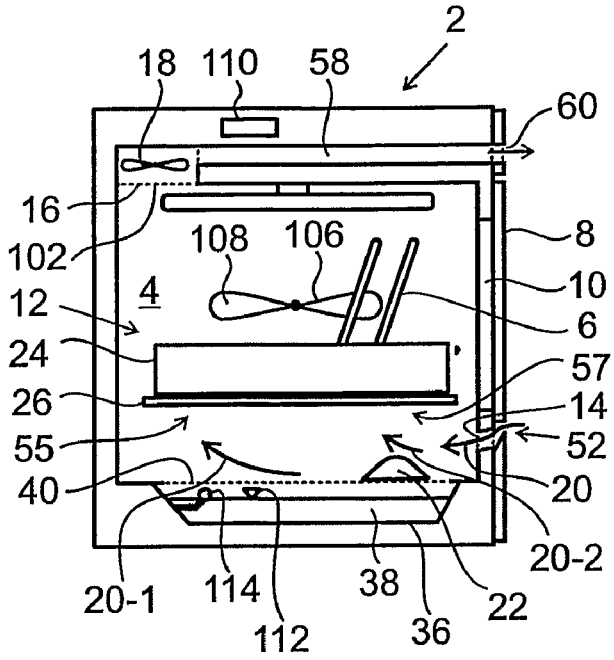
FIG. 4 shows a schematic sectional view of yet another embodiment of a commercial dishwasher according to the invention.

FIG. 1, FIG. 3 and FIG. 4 show a longitudinal section through a commercial dishwasher 2 which has a spray chamber 4 for holding items 6 to be washed and has a door 8 for closing a loading and unloading opening 10. The dishwasher 2 is designed for loading and unloading batches of items 6 to be washed into and from a region 12 for items to be washed in the spray chamber 4. An air inlet 14 into the spray chamber 4 is arranged below the door 8 at a point which is lower than the region 12 for items to be washed. An air outlet 16 out of the spray chamber 4 at a point which is higher than the region 12 for items to be washed is arranged at a point higher than the air inlet 14. The dishwasher 2 has a fan 18 for producing an air stream 20 along an air path 21, the air path 21 extending from the air inlet 14, through the spray chamber 4, to the air outlet 16. The air stream 20 in the spray chamber 4 is passed through the region 12 for items to be washed in order to dry the items 6 which have been washed. A deflector arrangement 22 having at least one deflector 23 (see FIG. 8) is arranged and designed to act on the air stream 20 entering the spray chamber 4 through the air inlet 14 and thus to cause the air stream to enter the region 12 for items to be washed in a uniformly distributed manner from below.

The spray chamber 4 has a volume of between 60 l and 280 l, for example.

The term "items 6 to be washed" includes, in particular, dishes, glasses, cutlery, pots and pans, containers, boxes, trays etc. The term "washing" includes, in particular, at least one of the processes "pre-cleaning", "cleaning", "post-cleaning", "final-rinsing" etc.

The region 12 for items to be washed is a region in the spray chamber 4 in which the items 6 to be washed are positioned in order to be cleaned. The items 6 to be washed are preferably arranged in a rack 24 in this case. The spray chamber 4 can contain one or more rack holders, for example as illustrated a single rack holder 26, on each of which a rack 24 is or can be positioned. As an alternative, two rack holders which are arranged one above the other may be provided for example.

A multiplicity of spray nozzles 28 are arranged in the spray chamber 4 for spraying washing liquid 38, for example cleaning liquid or final-rinse liquid, onto the items 6 to be washed. Separate spray nozzles 28 may be provided in each case for spraying cleaning liquid and final-rinse liquid. The spray nozzles 28 can, as illustrated, particularly be formed on rotatable spray pipes, on stationary spray pipes or in a spray-chamber wall. In the illustrated embodiments, the loading and unloading opening 10 is formed in a front-end spray-chamber wall 30. The spray-chamber floor 32 has a passage opening 34 into a tank 36 or into a reservoir which is provided for holding washing liquid 38. The passage opening 34 in the spray-chamber floor 32 is preferably covered by a tank screen 40. The dishwasher 2 is preferably intended to reuse at least some of the washing liquid 38 in the tank 36 for a further washing programme, that is to say for a new batch of items 6 to be washed. In particular, the dishwasher 2 may be designed to regenerate washing liquid 38.

The operating temperature of the washing liquid 38 in the tank 36 is preferably between 55° C. and 65° C. and is maintained by a suitable temperature-control apparatus. A temperature-control apparatus may be provided for final-rinse liquid (not illustrated), for example outside the spray chamber 4, which temperature-control apparatus preferably sets the temperature of the final-rinse liquid to between 63° C. and 85° C.

Figure 5:
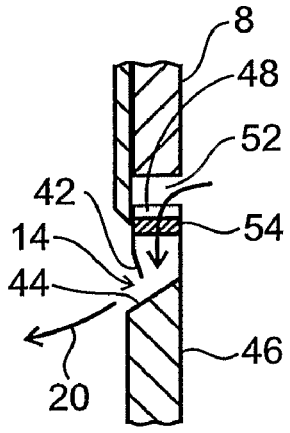
FIG. 5 shows a partial sectional view of yet another embodiment of a commercial dishwasher according to the invention.

According to an embodiment illustrated in FIG. 1, FIG. 4 and FIG. 5, the air inlet 14 is formed between guide elements 42, 44 which are connected to a machine housing 46 or are formed by it. In this case, an upper guide element 42 and a lower guide element 44 form at least one gap or slot. The lower guide element 44 is preferably inclined downwards towards the spray chamber 4 here. The upper guide element 42 is preferably inclined away from the spray chamber 4.

Figure 6:
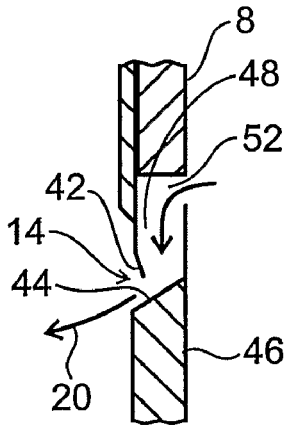
FIG. 6 shows a partial sectional view of yet another embodiment of a commercial dishwasher according to the invention.
Figure 7:
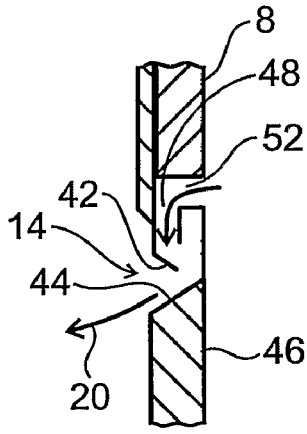
FIG. 7 shows a partial sectional view of yet another embodiment of a commercial dishwasher according to the invention.

A nozzle may be provided in place of a slot or a gap (not illustrated). One of the guide elements 42, 44, in particular the upper guide element 42, may be formed by the door 8 or be connected to the door 8, as illustrated in FIG. 6 and FIG. 7.

The air inlet 14 is preferably designed to produce an air stream 20 which covers the entire width of the region 12 for the items to be washed.

An air-inlet path 48 extends from a front face 50 of the dishwasher 2, through the lower gap 52 in the door, as far as the air inlet 14. As an alternative, the air-inlet path 48 can extend from an opening in a housing part or from an opening in the door 8 to the air inlet 14. The air-inlet path 48 is preferably labyrinthine (FIG. 1, FIG. 3, FIG. 7) in order to prevent washing liquid 38 escaping from the dishwasher 2 through the air-inlet path 48 during operation of the spray nozzles 28. A particle filter 54, for example a dust filter, may be arranged in the air-inlet path 48 (illustrated by way of example in FIG. 5).

Figure 8:
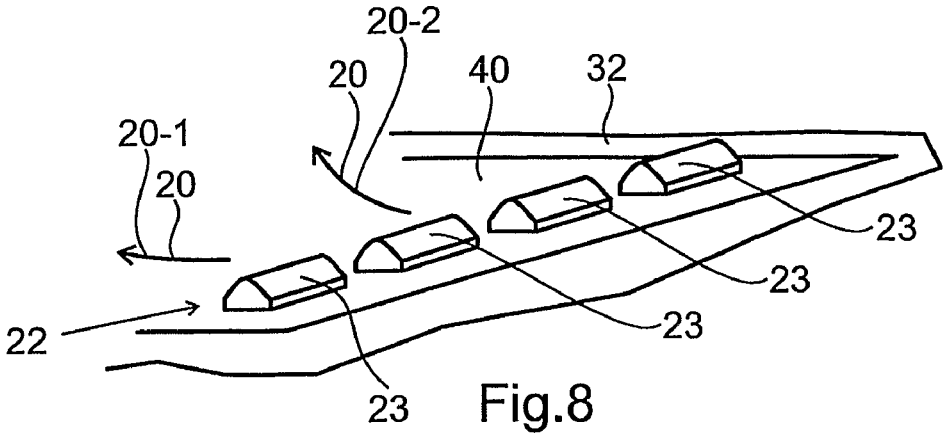
FIG. 8 shows a perspective partial view of a commercial dishwasher according to the invention.

The deflector arrangement 22, which is arranged in the air path 21 of the air stream 20, may be designed in one piece. As an alternative, the deflector arrangement 22 may be of multipartite design and have at least two deflectors 23, as is schematically illustrated in FIG. 8. The at least two deflectors 23 may be arranged at a distance from one another. In FIG. 8, the deflectors 23 are arranged at a distance from one another in a direction transverse to the air stream 20. In this way, a partial air stream 20-1 of the air stream 20, which does not strike a deflector 23, enters the region 12 for items to be washed in a rear part 55 of the region 12 for items to be washed, whereas a partial air stream 20-2 of the air stream 20, which strikes a deflector 23, enters the region 12 for items to be washed in a front part of the region 12 for items to be washed (see FIG. 4).

In the embodiments of a dishwasher 2 according to the invention illustrated in FIG. 1 and FIG. 3, the deflector arrangement 22 is arranged at a distance from the air inlet 14. In particular, the deflector arrangement 22 can be arranged on the spray-chamber floor 32, as illustrated in FIG. 1 and FIG. 3. As an alternative, the deflector arrangement 22 or at least one of its deflectors 23 can be arranged on the tank screen 40, as illustrated in FIG. 8. The deflector arrangement 22 can alternatively be arranged adjacent to the air inlet 14, for example on a spray-chamber wall. The air outlet 16 is arranged in an upper rear region 56 of the spray chamber 4. The air path 21 or the air stream 20 thus extends diagonally through the spray chamber 4, as a result of which a satisfactory drying result is achieved. As an alternative, the air outlet 16 may be arranged at another point above the region 12 for items to be washed.

An outlet duct 58 extends in the direction of flow downstream of the air outlet 16 from this air outlet 16 as far as a machine outlet 60 which is preferably arranged on the front face 50 of the machine, as illustrated in FIG. 1 to FIG. 4. The outlet duct 58 preferably extends above the spray chamber 4, as illustrated in FIG. 1, FIG. 3 and FIG. 4. An outlet cover 62 may be provided in order to conceal the machine outlet 60 in accordance with the desired appearance of the dishwasher.

An oblique run-off surface 61 can be formed below the machine outlet 60 in order to carry drops formed at the outlet back inward and behind the door 8. In the illustrated embodiment, the oblique run-off surface 61 is formed in one piece with the outlet cover 62. As an alternative, the oblique run-off surface 61 may be formed by a separate part, for example a housing part. In the illustrated embodiment, the drops which run off collect in a region 63 above the door seal 65 and when the door 8 is opened run down the door 8 into the spray chamber.

In the illustrated embodiments, the fan 18 is arranged in a region between the air outlet 16 and the machine outlet 60, and for sucking air out of the spray chamber 4. The fan 18 is preferably arranged at the air outlet 16. As an alternative to the illustrated embodiments, the fan may be arranged for blowing air into the spray chamber.

A condensate run-off 64 extends from the outlet duct 58 into the spray chamber 4, so that condensate or washing liquid which splashes into the outlet duct 58 can run off into the spray chamber 4. A bottom region 66 of the outlet duct 58 is preferably inclined towards the condensate run-off 64, so that condensate which collects at the bottom region 66 runs off towards the condensate run-off 64. As illustrated in FIG. 1 and FIG. 3, provision may particularly be made for a rotary shaft of a fan rotor 68 of the fan 18 to be inclined towards the condensate run-off 64, so that liquid in the fan 18 runs off towards the condensate run-off 64.

A condenser 70 (illustrated in dashed lines in FIG. 1 and FIG. 3) is arranged in the outlet duct 58 and serves for condensing moisture from air which is flowing out and thus dehumidifying the air which is flowing out. The condenser 70 is arranged downstream of the air outlet 16. In particular, the condenser 70 can be arranged downstream of the fan 18, as illustrated in FIG. 1 and FIG. 3. The condenser 70 can, for example, be formed by a heat exchanger which makes the heat of condensation, which is released during the condensation, available to the dishwasher 2 again. As an alternative, the condenser 70 can be cooled by cooling liquid, such as cooling water, or by cooling air, in order to dissipate the heat of condensation.

A closure element 72 is preferably arranged in the outlet duct 58, as illustrated in FIG. 1 and FIG. 3, for closing the outlet duct 58 when the fan 18 is switched off. The closure element 72 particularly prevents a spray mist moving out of the dishwasher 2 through the outlet duct 58 and the machine outlet 60 during operation of the spray nozzles 28. The closure element 72 may be a controllable closure element which is controlled by a control device (not illustrated). However, as illustrated, the closure element 72 is preferably formed by a flap which is automatically opened by the air stream 20 produced by the fan 18 and is automatically closed when the fan 18 is switched off. For this purpose, the flap is preferably mounted at its upper end 74, so that the flap is automatically closed by gravitational force when the fan 18 is switched off, as illustrated in FIG. 1 and FIG. 3.

Figure 9:
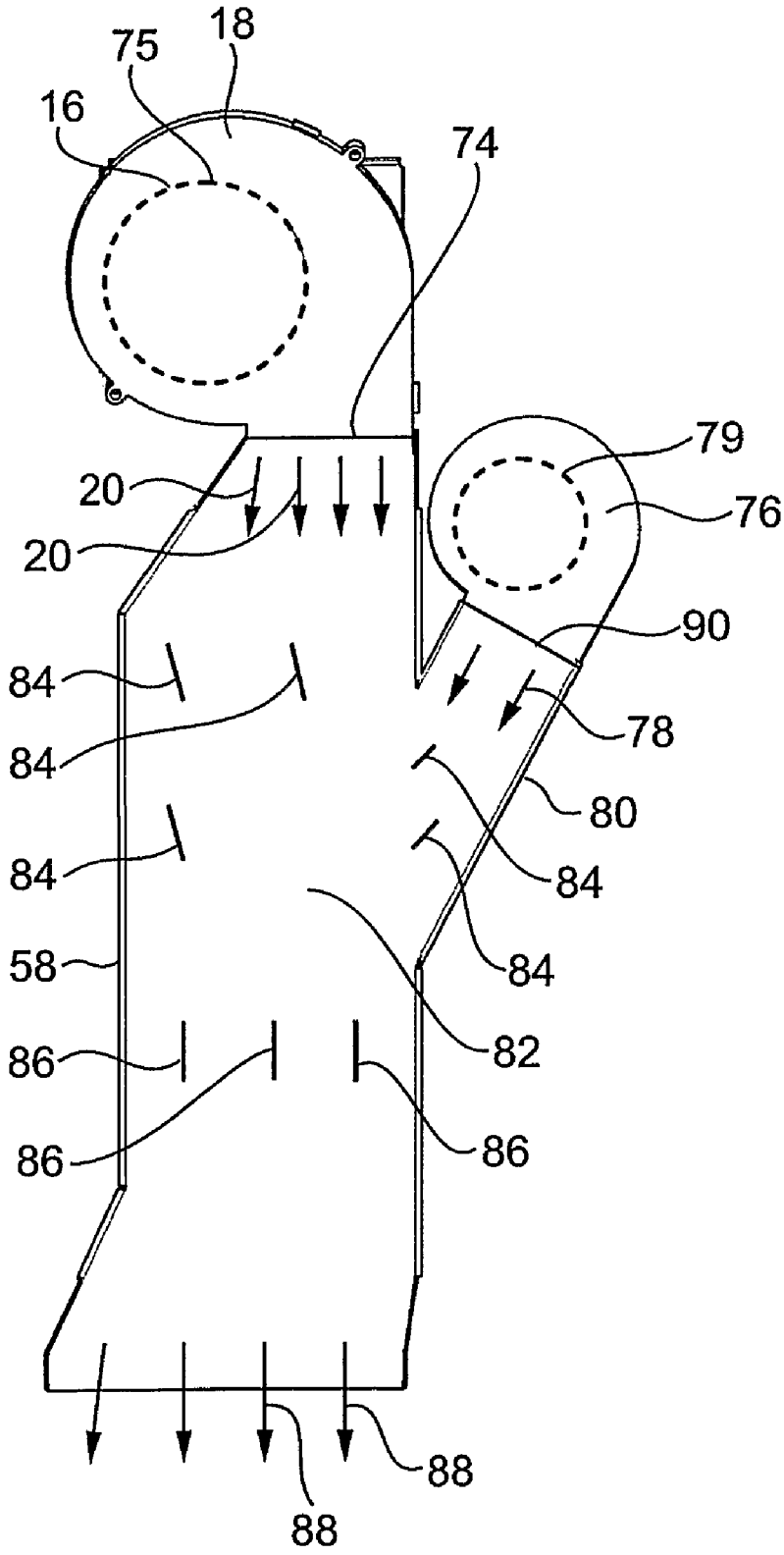
FIG. 9 shows a partial sectional view of an embodiment of an outlet duct according to the invention from above.

FIG. 9 shows a further embodiment of an outlet duct 58 from above. The air outlet 16 out of the spray chamber and the fan inlet 75 (illustrated in dashed lines) of the fan 18 can be found on the lower face of the fan 18 here, in accordance with the configuration in FIG. 1 and FIG. 3. Furthermore, an auxiliary fan 76 is provided for supplying ambient air 78 to the air stream 20 in the direction of flow of the air stream 20 downstream of the fan 18 and downstream of the air outlet 16. The auxiliary fan 76 is arranged so as to convey ambient air 78 into the outlet duct 58 through an auxiliary air duct 80. In the illustrated embodiment, a fan inlet 79 (illustrated in dashed lines) of the auxiliary fan 76 is arranged on the lower face of the auxiliary fan 76, but may be arranged at any other desired point in accordance with the type of fan used. An issue region 82, in which the auxiliary air duct 80 issues into the outlet duct 58, acts as a mixing chamber for mixing the ambient air 78, which is conveyed through the auxiliary air duct 80, and the air stream 20 from the spray chamber 4. As illustrated in FIG. 9, flow-guide elements 84 may be provided in order to improve thorough mixing of the two air streams. Flow-guide elements 86 may be provided in the direction of flow downstream of the issue region 82 for reducing turbulence in the resulting air stream 88. Conveying ambient air into the air stream 20 flowing out of the spray chamber 4 reduces a condensation effect, which is caused by the moisture-laden air flowing out of the spray chamber 4, outside the dishwasher 2. A closure element 90 may be arranged in the auxiliary air duct 80 for closing the auxiliary air duct 80 when the auxiliary fan 76 is switched off. The closure element 90 of the auxiliary air duct 80 may be formed, in particular, by a closure element, as has been described above with reference to the outlet duct 58.

In the illustrated embodiment, the fan 18 is designed to produce an air stream 20 at a rate which corresponds to 6 times to 12 times the volume of the spray chamber per minute.

A recirculation duct 92 which issues into the spray chamber 4 may be connected to the outlet duct 58 in the direction of flow downstream of the condenser 70, in order to at least partially recirculate dehumidified air from the outlet duct 58 into the spray chamber 4, as illustrated in FIG. 3. As illustrated, a flow-adjustment element 94 may be provided which can adjust the proportion of air which is recirculated into the spray chamber 4 from the outlet duct 58. By way of example, the flow-adjustment element 94 may be formed by a flap which can be moved into a first position in which the entire air stream 20 flowing through the outlet duct 58 is recirculated into the spray chamber 4 again. The flow-adjustment element 94 can preferably be moved into a second position in which the entire air stream 20 flowing through the outlet duct 58 is conducted out of the dishwasher 2 through the machine outlet 60. Furthermore, the flow-adjustment element 94 may be designed to set at least one intermediate position 96 in which an out-flowing part 98 of the air stream 20 flowing through the outlet duct 58 is conducted out of the dishwasher 2 through the machine outlet 60, and a recirculated part 100 of the air stream 20 is recirculated into the spray chamber 4. The flow-adjustment element 94 can be operated manually. The flow-adjustment element 94 may also be designed such that it can be controlled by the control apparatus 110 (see FIG. 4).

As illustrated in the drawings, the fan 18 is preferably arranged to suck air out of the spray chamber 4.

In the embodiments illustrated in FIG. 1 and FIG. 3, a splash guard 102 is arranged in front of the air outlet 16 in order to prevent or reduce liquid passing from the spray chamber 4 through the air outlet 16. The splash guard 102 may be equipped with a grease filter. In the illustrated embodiment, the splash guard 102 is arranged in relation to the condensate run-off 64 in such a way that condensate running off through the condensate run-off 64 drips onto the splash guard 102 and is conducted from the said splash guard to an edge region 104 of the spray chamber 4 and thus past the region 12 for items to be washed.

According to one embodiment of the dishwasher 2 illustrated in FIG. 4, a further fan in the form of a distributor fan 106 is provided for circulating air in the spray chamber 4 and thus achieving a more uniform drying result. In the illustrated embodiment, a rotor 108 of the distributor fan 106 is arranged in the spray chamber 4. However, the rotor of the distributor fan may also be arranged outside the spray chamber 4 (not illustrated).

A control apparatus 110 is provided for controlling the fan 18 and is illustrated by way of example in FIG. 4. The control apparatus 110 can also be provided for controlling further parts of the dishwasher 2, in particular for controlling one or more parts from amongst the auxiliary fan 76, distributor fan 106, closing element 74, 90, and flow-adjustment apparatus 94. The control apparatus 110 is preferably designed to operate the dishwasher 2 to provide one or more of the following features:

1. Varying the output of the fan 18 during the drying cycle for items which have been washed. For example, the output can be reduced at the beginning of the drying cycle for items which have been washed, in order to control the release of steam;
2. Operating the fan 18 at intervals;
3. Operating the fan 18 after a final-rinse cycle;
4. Switching on the fan 18 during a final-rinse cycle. This makes it possible to reduce the outlet of steam from the dishwasher 2.
5. Operating the auxiliary fan 76 with a constant output and operating the fan 18 with a reduced output at the beginning of the drying cycle for items which have been washed. This allows the ratio of the two air streams (air stream 20 through the outlet duct 58, ambient-air stream 78 through the auxiliary air duct 80) to be varied and thus allows the liquid content for each volume of air flowing out of the dishwasher 2 to be varied. These measures reduce the condensation effect outside the dishwasher 2, without the drying performance being significantly reduced with a comparable cycle time.

Parameters which primarily influence the drying result are:

1. The through-flow rate of the air stream 20 through the spray chamber 4;
2. The speed of the air stream 20 along the items 6 to be washed;
3. The achieved final temperatures of the items 6 to be washed, of the rack and of the washing chamber;
4. The optimized final-rinse distribution;
5. The design of the rack in which the items 6 to be washed are or will be arranged, in particular the water-repellent properties of the rack; the thermal capacity of the rack; a minimum number of areas of contact with the items 6 to be washed; choice of rack design such that water cannot flow off the rack 24 and over the items 6 to be washed;

6. The tank 36 which is covered by the tank screen 40;
7. The liquid level 112 in the tank 36, which level is regulated to stay below the tank screen 40 by the control apparatus 110; at least one level sensor 114 or at least one level switch may be provided for detecting an actual level value.

The invention provides the following advantages in particular:

1. Drying of the items 6 which have been washed in the dishwasher 2 in an acceptable time which is between 1 min. and 5 mins, and is preferably less than 3 mins;
2. Items 6 which have been washed can be used immediately ("ready to use") and without an additional waiting time, this being advantageous for the "work flow";
3. An improved uniform drying result is achieved, in particular for hollow items 6 which have been washed, such as glasses;
4. No steam escapes when the door 8 is opened; the items 6 which have been washed are cooled after the washing programme is complete; the items 6 which have been washed can be stored immediately after the washing programme is complete.

The illustrated embodiments implement the combination of a high air through-flow rate with air-guide apparatuses and/or deflectors 23, so that the drying result is based not only on the dehumidification of the spray-chamber atmosphere, but on air being blown from below through the rack 24 or racks and along the items 6 which have been washed.

A person skilled in the art understands that features which are illustrated and explained only in one or some of the described embodiments, such as the distributor fan 106, the level sensor 114 or the auxiliary fan 76, can also be combined with any of the other embodiments of the invention.

The invention claimed is:

1. Commercial dishwasher which has a spray chamber for holding items to be washed and has a door for closing a loading and unloading opening, and which is designed for loading and unloading batches of items to be washed into and from a region for items to be washed in the spray chamber, characterized by an air inlet into the spray chamber, which inlet is arranged below the door at a point which is lower than the region for items to be washed, the air inlet configured to produce an air stream that covers the width of the region for items to be washed;

an air outlet, which is formed at a point higher than the air inlet, out of the spray chamber at a point which is higher than the region for items to be washed;

a fan for producing an air stream along an air path which extends from the air inlet, through the spray chamber, to the air outlet, with the air stream in the spray chamber being passed through the region for items to be washed in order to dry the items which have been washed; and a deflector arrangement which is arranged and designed to act on the air stream entering the spray chamber through the air inlet and thus to cause the air stream to enter the region for items to be washed in a uniformly distributed manner from below, the deflector arrangement including multiple deflectors located within a front portion of the spray chamber and spaced inwardly from the door, the deflectors spaced from each other in a direction transverse to the air stream such that part of the air stream is deflected by the deflectors upward into the region for items to be washed at a front part of the region and part of the air stream passes by the deflectors so as to enter the region for items to be washed at a rear part of the region.

2. Dishwasher according to claim 1, characterized in that the air inlet is formed by the door and a guide element, the guide element is connected to a machine housing or is formed by the machine housing.

3. Dishwasher according to claim 1, characterized in that the air inlet is formed between guide elements, each guide element is connected to a machine housing or is formed by the machine housing.

4. Dishwasher according to claim 1, characterized in that the air outlet is arranged in an upper rear region of the spray chamber.

5. Dishwasher according to claim 4, characterized by an outlet duct which extends from the air outlet as far as a machine outlet.

6. Dishwasher according to claim 5, characterized in that the outlet duct extends from the air outlet forward above the spray chamber, and in that the machine outlet is arranged on the front face of the machine above the door.

7. Dishwasher according to claim 6, characterized in that a condensate run-off extends from the outlet duct into the spray chamber.

8. Dishwasher according to claim 7, characterized in that a closure element is arranged in the outlet duct for closing the outlet duct when the fan is switched off.

9. Dishwasher according to claim 4, characterized in that a condenser for condensing moisture from air which is flowing out is arranged downstream of the air outlet.

10. Dishwasher according to claim 9, characterized in that the condenser is arranged downstream of the fan.

11. Dishwasher according to claim 10, characterized in that a recirculation duct which issues into the spray chamber is connected to the outlet duct in the direction of flow of the air stream downstream of the condenser, in order to at least partially recirculate dehumidified air from the outlet duct into the spray chamber.

12. Dishwasher according to claim 1, characterized in that the fan is arranged in the region between the air outlet and the machine outlet.

13. Dishwasher according to claim 1, characterized in that the fan is arranged at the air outlet.

14. Dishwasher according to claim 1, characterized in that an auxiliary fan is provided for supplying ambient air to the air stream in the direction of flow of the air stream downstream of the fan and downstream of the air outlet.

15. Dishwasher according to claim 1, characterized in that the fan is arranged to suck air out of the spray chamber.

16. Dishwasher according to claim 1, characterized in that the fan produces an air stream at a rate which corresponds to 6 times to 12 times the volume of the spray chamber per minute.

17. Dishwasher according to claim 1, characterized in that a control apparatus is provided for controlling the fan; and in that the control apparatus is designed to vary the output of the fan during a drying cycle for items which have been washed.

* * * * *